US007246442B2

(12) United States Patent
Tanaka

(10) Patent No.: US 7,246,442 B2
(45) Date of Patent: Jul. 24, 2007

(54) HAIR-TRIMMING TOOL

(76) Inventor: Takanori Tanaka, c/o Anne Beauty Salon, 27-102, Hagoromo-cho 5, Nishinomiya-shi, Hyogo-ken, 662-0051 (JP)

( * ) Notice: Subject to any disclaimer, the term of this patent is extended or adjusted under 35 U.S.C. 154(b) by 292 days.

(21) Appl. No.: 10/852,456

(22) Filed: May 25, 2004

(65) Prior Publication Data

US 2004/0237313 A1 Dec. 2, 2004

(30) Foreign Application Priority Data

May 27, 2003 (JP) ..... 2003-149108
Feb. 25, 2004 (JP) ..... 2004-050210

(51) Int. Cl.
*B26B 13/10* (2006.01)

(52) U.S. Cl. ..... 30/195; 30/51; 30/253; 30/236

(58) Field of Classification Search ..... 30/30, 30/195, 213, 233.5, 253, 194, 230, 234, 236, 30/43, 51, 53, 131, 331, 349; 7/134–136; D08/57; D28/52; 132/213, 213.1, 212, 214, 132/223

See application file for complete search history.

(56) References Cited

U.S. PATENT DOCUMENTS 604,821 A * 5/1898 Burke ..... 30/233
2,267,949 A * 12/1941 Reed ..... 30/195
2,606,365 A * 8/1952 Pileggi ..... 30/195
3,972,333 A * 8/1976 Leveen ..... 606/174
5,050,304 A * 9/1991 Fujikawa et al. ..... 30/196
5,123,159 A * 6/1992 Kubo et al. ..... 30/196
5,195,245 A * 3/1993 Malone ..... 30/195
5,237,750 A * 8/1993 Nakano et al. ..... 30/131
5,758,422 A * 6/1998 Frank ..... 30/230
6,249,973 B1 * 6/2001 Hirano ..... 30/30
6,317,987 B1 * 11/2001 Joung ..... 30/236
D452,125 S * 12/2001 Quessard ..... D8/57
6,665,938 B2 * 12/2003 McCambridge et al. ..... 30/201
6,722,039 B2 * 4/2004 Kitano ..... 30/50
D503,323 S * 3/2005 Hasegawa et al. ..... D8/57
2004/0045168 A1 * 3/2004 Talavera ..... 30/133
2005/0044723 A1 * 3/2005 Sato ..... 30/253

* cited by examiner

*Primary Examiner*—Boyer D. Ashley
*Assistant Examiner*—Laura M. Lee
(74) *Attorney, Agent, or Firm*—Fitch Even Tabin & Flannery

(57) ABSTRACT

A hair-trimming tool including a tool body having a pair of hair-bunch supporting pieces whose tip ends can open and close, a connecting portion which connects base ends of the hair-bunch supporting pieces, a protruding portion protruding from the connecting portion in a direction substantially perpendicular to an opening/closing direction of the hair-bunch supporting pieces, cutting element provided on at least one of the inner opposing surfaces of the hair-bunch supporting pieces along a longitudinal direction thereof, wherein the cutting element is disposed substantially in parallel to a scalp in a cut-starting attitude where a tip end of the protruding portion comes into contact with the scalp, and a holding element provided on a surface of the hair-bunch supporting piece opposed to the scalp in the cut-starting attitude to hold the lower side of a hair-bunch at a given angle to the scalp.

8 Claims, 9 Drawing Sheets

HAIR-TRIMMING TOOL

BACKGROUND OF THE INVENTION

1. Field of the Invention

The present invention relates to a hair-trimming tool, and more particularly, to a hair-trimming tool allowing an unskilled person to easily cut hair.

2. Disclosure of the Prior Art

Shaggy cut for cutting hair aslant to reduce the bulk of the entire hair is positively used not only for suppressing a volume of hair but also for creating hairstyle having excellent design.

Hairstyle comprises a plurality of divided hair-bunches. If all of the divided hair-bunches are cut at a constant angle to a scalp and at a constant length and all the hair-bunches are aligned to a constant shape, beautiful and stable hairstyle can be formed. To form the hairstyle, as shown in FIG. 9(A), a professional hairdresser pulls each hair-bunch (2) up at an angle of about 90° to the scalp, the hair-bunch (2) is sandwiched between fingers of one hand and in this state, the hair-bunch (2) is cut using scissors or a razor with the other hand.

Particularly, the shaggy cut is carried out for forming a three dimensional hairstyle by dynamically shaping hair tips. To form this hairstyle by the shaggy cut, as shown in FIG. 9(B), it is necessary to cut the hair aslant while carefully put the lengths of the hair-bunches (20) such that all the hair-bunches (20) are formed into the same outline. High skill is required to carry out the shaggy cut precisely using only the scissors or razor, and this is a difficult work for an unskilled person.

To make this kind of work or operation easy, there has been invented a hairdressing tool as disclosed in Japanese Patent Application Laid-open No. 2001-757 and Japanese Utility Model Registration No. 3005258. There also have been invented many home or domestic hairdressing tools as disclosed in Japanese Patent Application Laid-open No. H8-150272 in which the tool sandwiches a hair-bunch, the tool is moved along the hair, thereby cutting the sandwiched hair aslant. These conventional hairdressing tools eliminate the troublesome of shifting a comb and a razor from one to the other hand, it becomes easy to cut hair with excellent design, and various cuttings can be carried out at home.

However, above-mentioned conventional razor tools are usually used by a professional hairdresser at a beauty salon.

These tools facilitate the cutting operation but high skill is required to precisely cut the hair. The home hairdressing tool is provided such that hair can easily be cut also at home, but a cut-starting position of each hair-bunch and a direction for moving the tool are determined by eye-measurement for each hair-bunch. Therefore, cutting becomes unstable, and it is difficult to cut all the hair-bunches in the same manner and to complete a stable and beautiful hairstyle entirely.

SUMMARY OF THE INVENTION

It is an object of the present invention to propose a hair-trimming tool with which anyone can easily cut hair to form favorite hairstyle.

It is another object of the invention to propose a hair-trimming tool with which anyone can easily pull up a hair-bunch while maintaining a constant angle to a scalp when cutting hair using scissors.

To achieve the first object, according to technical means of the present invention, there is provided a hair-trimming tool having a tool body comprising a pair of hair-bunch supporting pieces whose tip ends can open and close, a connecting portion for connecting base ends of the hair-bunch supporting pieces with each other, a protruding portion protruding from the connecting portion in a direction substantially perpendicular to an opening and closing direction of the hair-bunch supporting pieces, and cutting means provided on one or both of opposed inner surfaces of the hair-bunch supporting pieces in its longitudinal direction, wherein the cutting means is disposed substantially in parallel to a scalp in a cut-starting attitude in which a tip end of the protruding portion comes into contact with a predetermined position of the scalp, and holding means is provided on a predetermined position of a surface opposite the scalp of the hair-bunch supporting piece in the cut-starting attitude for holding lower side of a hair-bunch at a constant angle to the scalp.

The above technical means functions as follows:

One of hands forms the hair-bunch, and the other hand grasps the pair of hair-bunch supporting pieces such that they can open and close and the hair-bunch is sandwiched between the hair-bunch supporting pieces. It is preferable that the hair-bunch is vertically long, i.e., a lateral width of the hair-bunch is longer than a vertical width thereof. An angle of the tool body to the scalp is adjusted such that the cutting means provided on the hair-bunch supporting pieces are located substantially in parallel along the scalp. In this state, the protruding portion provided on the connecting portion is abutted against a predetermined position of the scalp below the hair-bunch. This is the cut-starting attitude of the tool body. The lower side of the hair-bunch at that time is held by the holding means and thus, even if the user moves his or her hand of f the hair-bunch, the hair-bunch does not fall down lower than the holding means, the lower side of the hair-bunch is held at the constant angle to the scalp. From the state where the hair-bunch is held by the holding means, the lower side of the hair-bunch is sent to the cutting means forming region. The hair-bunch supporting pieces are gradually closed from the cut-starting attitude around the protruding portion, which is in contact with the scalp. In this state, the tool body is turned in a direction in which the hair-bunch supporting pieces are separated away from the scalp. With this, as the hair-bunch supporting pieces are closed and turned, the hair-bunch is sequentially cut from its portion which comes into contact with the cutting means, and the shaggy cut is completed. By repeating this operation sequentially from the top of the head toward the neck, all the hair-bunches are formed into the same outline.

The cutting means may be provided on one of or both of the hair-bunch supporting pieces. If the cutting means is provided on only one of the hair-bunch supporting pieces, a hair-bunch is formed into an outline in which only one side is cut aslant, and if the cutting means is provided on both of the hair-bunch supporting pieces, the hair-bunch is formed into a substantially V-shaped outline in which both sides are similarly cut aslant.

Since the present invention has the above structure, the following special effects are obtained.

A sandwiching manner of the hair-bunch between the hair-bunch supporting pieces, the contact position of the protruding portion to the scalp, the attitude when the tool body starts cutting, and the force acting on the hair-bunch supporting pieces are set substantially the same, and the tool body is turned in the direction in which the tool body is separated from the scalp around the protruding portion which is in contact with the scalp. Only with this operation, all the hair-bunches can be formed into the same outline. The cutting operation can be carried out in a stable state by bringing the protruding portion into contact with the scalp. Therefore, anyone can easily and precisely form hair-bunches having shaggy without requiring skill only by repeating the same operation, and can complete an imaged hairstyle.

If the cutting means are provided on both of the pair of hair-bunch supporting pieces, the cutting efficiency of the hair-bunch is enhanced, and time required for cutting is shortened. Since both sides of the hair-bunch are cut, it is possible to form three-dimensional hair-bunch.

The lower side of the hair-bunch is held by the holding means. Thus, after the hair-bunch is held at the constant angle to the scalp, the hair-bunch is sent to the cutting means and cut. Therefore, it is possible to prevent the lower side of the hair-bunch from being cut short unintentionally. With this, it is possible to form a natural step on the tip end of the hair-bunch after cutting from the upper portion to the lower side of the hair-bunch, and to obtain the same hair cut as that by a skilled person.

Since the hair-bunch is formed downwardly from the top of the head, it is easy to recognize the entire outline of the hairstyle, and to form an imaged hairstyle more precisely.

In the above hair-trimming tool, grooves are formed in the inner surfaces of the hair-bunch supporting pieces along a forming region of the cutting means, the cutting means comprises a holder which is detachably embedded in the groove, and a razor blade mounted along a longitudinal direction of the holder, the razor blade is fitted such that it inclines in a direction for turning the hair-bunch supporting piece at an angle of about 45° to the inner surface. In this hair-trimming tool, if the tool body is turned around the protruding portion while sandwiching the hair-bunch between the hair-bunch supporting pieces in the above-described manner, the hair-bunch is sequentially cut by the razor blade. Since the razor blade is mounted on the holder such that the razor blade is inclined at about 45° to the turning direction, as the hair-bunch supporting pieces turn, the hair-bunch is cut in the same manner as the conventional cutting manner using a razor. The razor blade can be removed from the groove together with the holder and can be replaced by another razor blade.

Since it is possible to cut hair using this hair-trimming tool in the same way the conventional razor is used, there is effect that it is easy to use this hair-trimming tool, and its handling is easy and safety. Further, when the cutting means is to be replaced, only the holder having the razor blade may be replaced, there is no wastage.

To achieve the second object, according to technical means of the present invention, there is provided a hair-trimming tool having a tool body comprising a pair of hair-bunch supporting pieces whose tip ends can open and close, a connecting portion for connecting base ends of the hair-bunch supporting pieces with each other, a protruding portion protruding from the connecting portion in a direction substantially perpendicular to an opening and closing direction of the hair-bunch supporting pieces, and comb means provided on one or both of opposed inner surfaces of the hair-bunch supporting pieces in its longitudinal direction, wherein the comb means comprises a holder detachably embedded in a groove provided in an inner surface of each of the hair-bunch supporting pieces substantially in parallel to the scalp in a comb-starting attitude in which a tip end of the protruding portion comes into contact with a predetermined position of the scalp, and a comp portion mounted along a longitudinal direction of the holder, and holding means is provided on a predetermined position of the hair-bunch supporting piece opposed to the scalp in the comb-starting attitude for holding lower side of a hair-bunch at a constant angle to the scalp.

In this hair-trimming tool, the cutting means of the technical means for achieving the first object is replaced by the comb means, and the comb portion is mounted on the holder instead of the razor blade.

The hair-bunch is sandwiched between the hair-bunch supporting pieces, the protruding portion is abutted against the scalp located below the hair-bunch such that the comb means provided on the hair-bunch supporting pieces is located substantially in parallel along the scalp, and the attitude of the tool body with respect to the scalp is adjusted. This is the comb-starting attitude. At that time, the lower side of the hair-bunch is held by the holding means. From this comb-starting attitude, the hair-bunch supporting pieces are closed, and in this state, the tool body is turned around the protruding portion in a direction in which the hair-bunch supporting pieces are separated from the scalp. With this, the hair-bunch is pulled up while being combed sequentially by the comb portion of the comb means in a state in which the hair-bunch is held by the holding means at the constant angle to the scalp. When the tool body is turned through a predetermined angle, a tip end of the hair-bunch protruding outward from the hair-bunch supporting pieces is cut by scissors. By repeating this operation sequentially from the top of the head toward the neck, all the tip ends of the hair-bunches are cut into the same outline.

Other object, features, aspects and advantages of the invention will become more apparent from the following detailed description of embodiments with reference to the accompanying drawings and appended claims.

DETAILED DESCRIPTION OF THE EMBODIMENTS

Embodiments of the present invention will be explained in detail with reference to the drawings.

Figure 1:
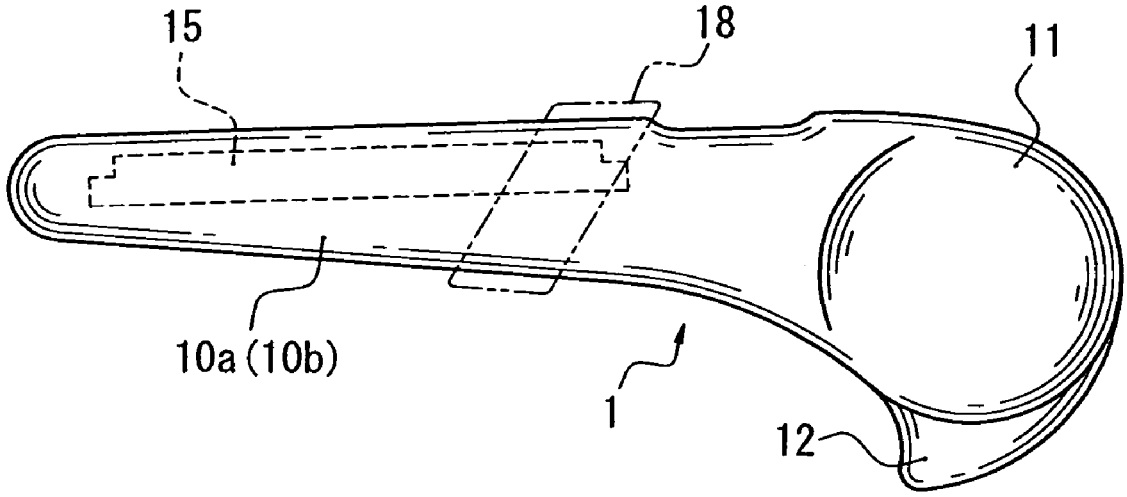
FIG. 1 is a side view of a hair-trimming tool according to a first embodiment of the present invention.
Figure 2:
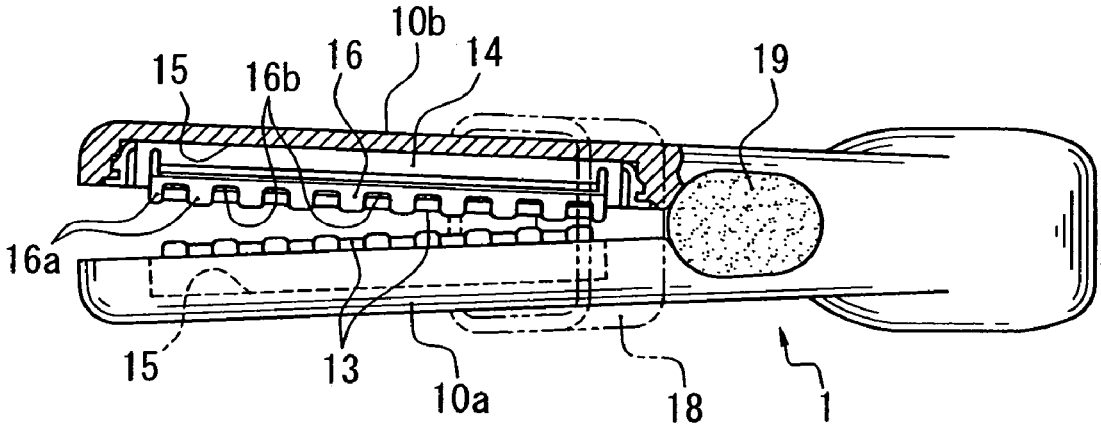
FIG. 2 is a partially cut-away plan view of FIG. 1.

FIG. 1 is a side view of a tool body (1) of a hair-trimming tool according to a first embodiment of the present invention. FIG. 2 is a partially cut-away plan view thereof.

The tool body (1) comprises a pair of hair-bunch supporting pieces (10*a*) and (10*b*), and a connecting portion (11) which connects the hair-bunch supporting pieces (10*a*) and (10*b*) such that the pieces can open and close. Each of the hair-bunch supporting pieces (10*a*) and (10*b*) has a semi-circular cross section which protrudes outward, and a protruding portion (12) protrudes from a predetermined location of the connecting portion (11) rotated in a circumferential direction with respect to the protruding direction of the hair-bunch supporting pieces (10*a*) and (10*b*) through about 90°.

Grooves (15) in which holders (14) are accommodated are formed in opposed inner surfaces of the hair-bunch supporting pieces (10*a*) and (10*b*) along their longitudinal directions. A razor blade (13) as cutting means is mounted on the holder (14).

Figure 3:
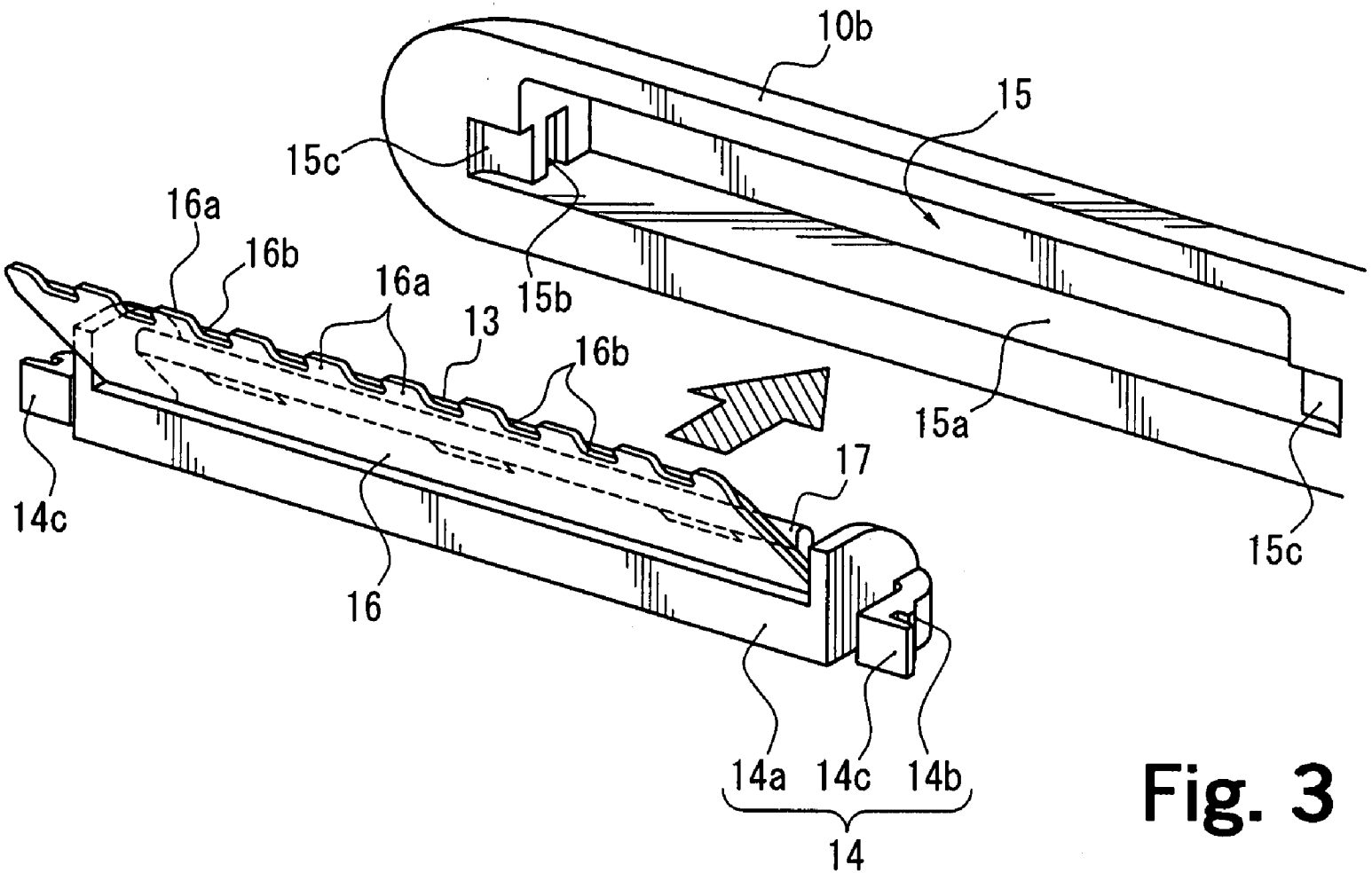
FIG. 3 is an exploded perspective view showing a relation between a holder having a razor blade of the hair-trimming tool of the first embodiment and a hair-bunch supporting pieces for accommodating the holder.

As shown in FIG. 3, pawls (14*b*) of the holders (14) are provided on both end surfaces of holder main bodies (14*a*) such that the pawls (14*b*) can rock in the axial direction around base ends. The holder main body (14*a*) includes a razor blade (13) and a safety cover (16) disposed along the razor blade (13). The groove (15) comprises a holder main body accommodating section (15*a*) in which the holder main body (14*a*) is accommodated, pawl-engaging recesses (15*b*) formed in opposite side surfaces of the holder main body accommodating section (15*a*) for allowing the pawls (14*b*) to engage with the pawl-engaging recesses (15*b*) in one way, and shallow grooves (15*c*) formed in opposite ends of the open ends of the holder main body accommodating section (15*a*) for accommodating the rocking operating sections (14*c*) which are free ends of the pawls (14*b*).

If the holder (14) is forcibly fitted into the groove (15) in a direction shown in the drawing, the holder main body (14*a*) is fitted into the holder main body accommodating section (15*a*) while resiliently rocking the pawl (14*b*) inward, and when the pawl (14*b*) engages with the pawl-engaging recess (15*b*) in one way, the holder (14) is accommodated in the groove (15) such that the holder (14) is prevented from being pulled out.

At that time, the rocking operating section (14*c*) is accommodated in the shallow groove (15*c*), and if the rocking operating section (14*c*) is resiliently deformed inward, the one way engagement is released. Thus, the holder (14) can be detached out from the groove (15).

The holder (14) is provided with a support plate (17) such that the support plate (17) inclines at an angle of 45° to a horizontal bottom surface. The razor blade (13) and the safety cover (16) are inserted into the holder (14) along the support plate (17), thereby constituting the cutting means.

The safety cover (16) is a thin plate having almost the same size as that of the razor blade (13). One side of the safety cover (16) on which the blade tips of the razor blade (13) are formed is formed into corrugated shape having protrusions and recesses. The corrugated protruding portion (16*a*) is higher than the blade of the razor blade (13), and the recess (16*b*) is lower than the razor blade (13). The blade of the razor blade (13) is exposed between the protruding portion (16*a*) and the protruding portion (16*a*) (above the recess (16*b*)).

The safety covers (16) employed in this embodiment are disposed such that when the hair-bunch supporting pieces (10*a*) and (10*b*) are closed, the protruding portion (16*a*) of the safety cover (16) provided on the one hair-bunch supporting piece (10*a*) corresponds to the recess (16*b*) of the safety cover (16) provided on the other hair-bunch supporting piece (10*b*) so that the protruding portion (16*a*) does not hinder when the hair-bunch supporting pieces (10*a*) and (10*b*) are closed.

The inclination direction of the support plate (17) is set such that in a state in which the holders (14) are respectively set to the hair-bunch supporting pieces (10*a*) and (10*b*), the razor blade (13) and the safety cover (16) project in a direction opposite from the projecting direction of the protruding portion (12) of the tool body (1) at an angle of 45°.

As shown in FIGS. 1 and 2, a synthetic resin annular coating body (18) is mounted, as holding means for holding lower side (21*a*) of the hair-bunch (21), in the vicinity of base ends of the hair-bunch supporting pieces (10*a*) and (10*b*). Since the coating body (18) is put on the opened hair-bunch supporting pieces (10*a*) and (10*b*), the coating body (18) does not affect the opening and closing motions of the hair-bunch supporting pieces (10*a*) and (10*b*). The coating body (18) may be movable along the longitudinal direction of the hair-bunch supporting pieces (10*a*) and (10*b*) through some distances.

Next, a cutting method of hair using the tool body (1) will be explained.

First, hair is radially divided into a plurality of groups from a top of head, and each of the divided hair groups is further divided into a plurality of hair pieces in the vertical direction in accordance with a hairstyle. Hair belonging to each hair piece is defined as one hair-bunch (21).

It is preferable that each hair-bunch (21) has a width of about 2 cm and a length of about 5 to 6 cm. Hair cutting is carried out downward (neck side) from the hair-bunch (21) of the top of the head.

More specifically, a user picks up one hair-bunch (21) of the top of the head with one hand, and grasps the tool body (1) with the other hand (habitual hand), and inserts the tool body (1) between the hair-bunch supporting pieces (10*a*) and (10*b*) such as to receive the hair-bunch (21) from below. At that time, the protruding portion (12) is directed to the scalp (22).

Figure 4:
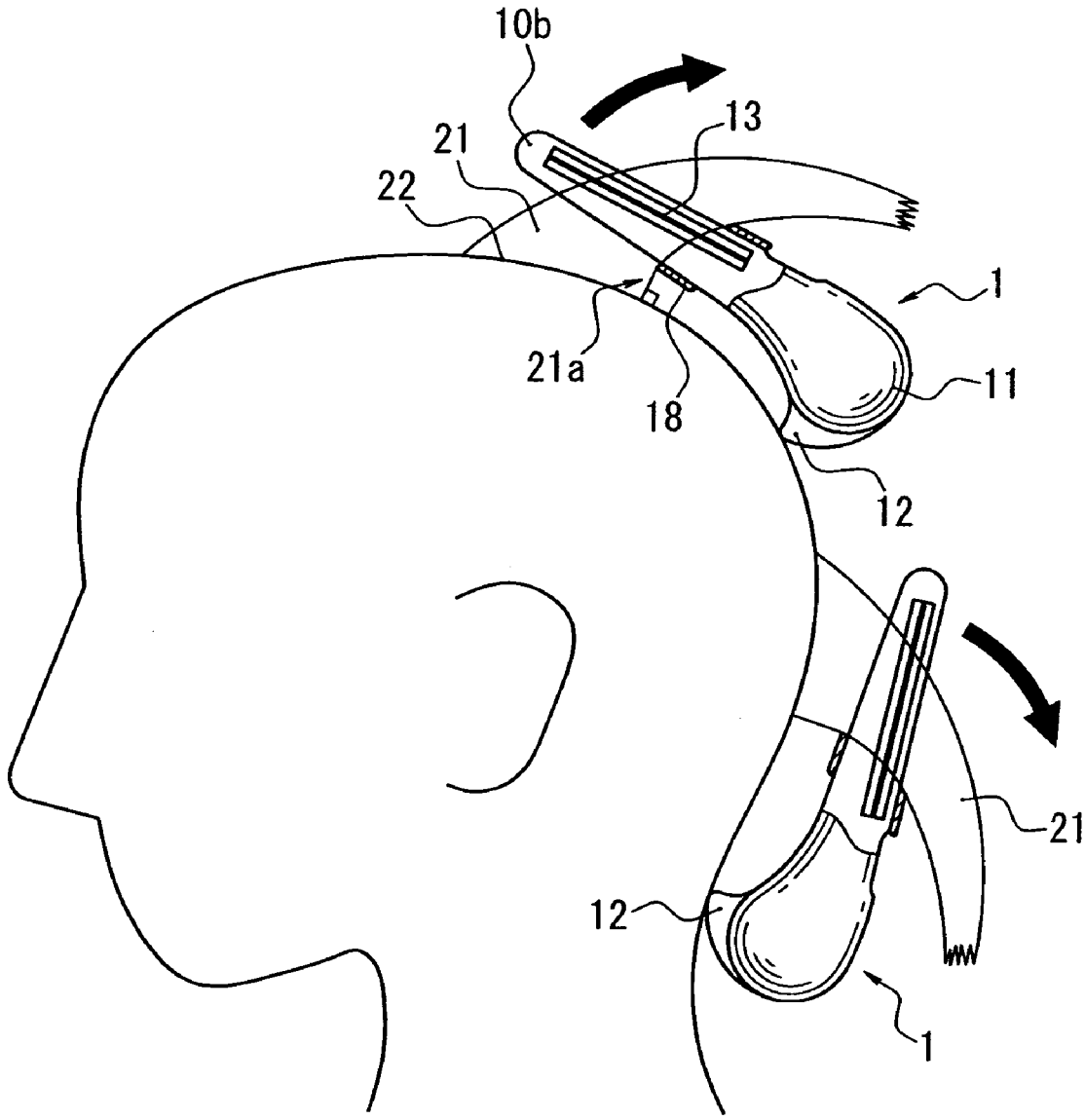
FIG. 4 is an explanatory view showing a using state of the hair-trimming tool of the embodiment of the invention.

As shown in FIG. 4, when the hair-bunch supporting pieces (10*a*) and (10*b*) are positioned substantially in parallel to the scalp (22), the protruding portion (12) is allowed to come into contact with the scalp (22). This is a cut-starting attitude. In this attitude, hair located lower side of the hair-bunch (21) is retained by an end edge of the coating body (18) and thus, the hair is not further hung down toward the connecting portion (11). In FIG. 4, the lower side (21*a*) of the hair-bunch (21) is held in a state in which the lower side (21*a*) is pulled up at about 90° to the scalp (22), and after the lower side (21*a*) of the hair-bunch (21) is once held at a predetermined height by the coating body (18), the lower side (21*a*) is naturally sent to a razor blade (13) forming region.

In other words, at the instant when the hair-bunch (21) is sandwiched between the hair-bunch supporting pieces (10*a*) and (10*b*), the lower side (21*a*) of the hair-bunch (21) is not hung down by gravity. Therefore, there is no inconvenience that the hair is sent directly to the razor blade (13) forming region and the lower side of the hair-bunch (21) are unintentionally cut short and the hair length becomes uneven, or inconvenience that the hair is hung down to the cutting means non-forming region of the base ends of the hair-bunch supporting pieces (10*a*) and (10*b*), and the hair can not be cut.

In the cut-starting attitude, it is preferable that an angle between the scalp (22) and the lower side (21*a*) of the hair-bunch (21) retained by the coating body (18) is about 60 to 90°.

Figure 5:
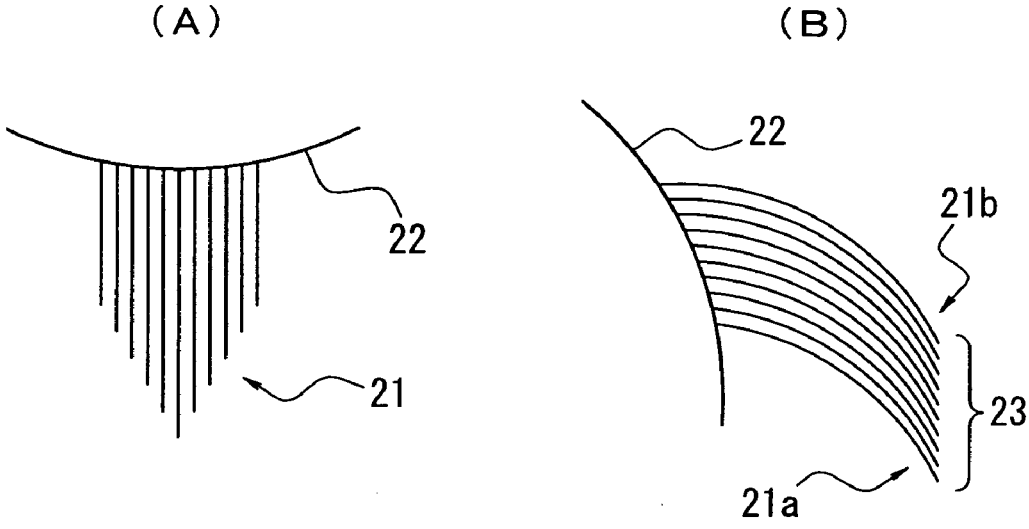
FIG. 5 are explanatory view showing a shape of a hair-bunch which is cut by the hair-trimming tool of the embodiment of the invention, wherein (A) is a plan view and (B) is a side view.

From this cut-starting attitude, the hair-bunch supporting pieces (10*a*) and (10*b*) are gradually opened around the contact point between the protruding portion (12) and the scalp (22) and in this state., the hair-bunch supporting pieces (10*a*) and (10*b*) are turned in a direction (direction shown with an arrow in FIG. 4) away from the scalp (22). With this, the hair-bunch (21) sandwiched between the hair-bunch supporting pieces (10*a*) and (10*b*) is gradually cut from its portion which comes into contact with the razor blade (13). If the hair-bunch (21) is viewed from above as shown in FIG. 5(A), a tapered outline is formed, and since the lower side (21*a*) of the hair-bunch (21) is not cut shorter than necessary length. Therefore, if the hairstyle is viewed from side, as shown in FIG. 5(B), it is possible to carry out a beautiful shaggy cut in which a natural step (23) of about 3 to 5 cm continues from a tip end of the upper side (21*b*) of the hair-bunch (21) toward the tip end of the lower side (21*a*).

The razor blade (13) is accommodated in the holder (14) in a state in which the razor blade (13) is inclined at an angle of 45° toward the turning direction of the hair-bunch supporting pieces (10*a*) and (10*b*). Therefore, if the tool body (1) is turned, the razor blade (13) abuts against the hair-bunch (21) at an angle of about 45°. With this, the same cut section as that obtained using the conventional razor is obtained.

In the present invention, hair cut is carried out by turning the tool body (1) around the protruding portion (12) which comes into contact with the scalp (22). Thus, it is possible to cut hair always stably. By repeating this operation sequentially from the top of the head toward the neck, all the hair-bunches (21) can be cut in the same three-dimensional form. With this, anyone can easily carry out the shaggy cut within short time and without skill. Since hair is cut from the top of the head, it is possible to cut hair while seeing the entire length and the cutting process, and it is possible to complete the hairstyle as imaged more than former.

Figure 6:
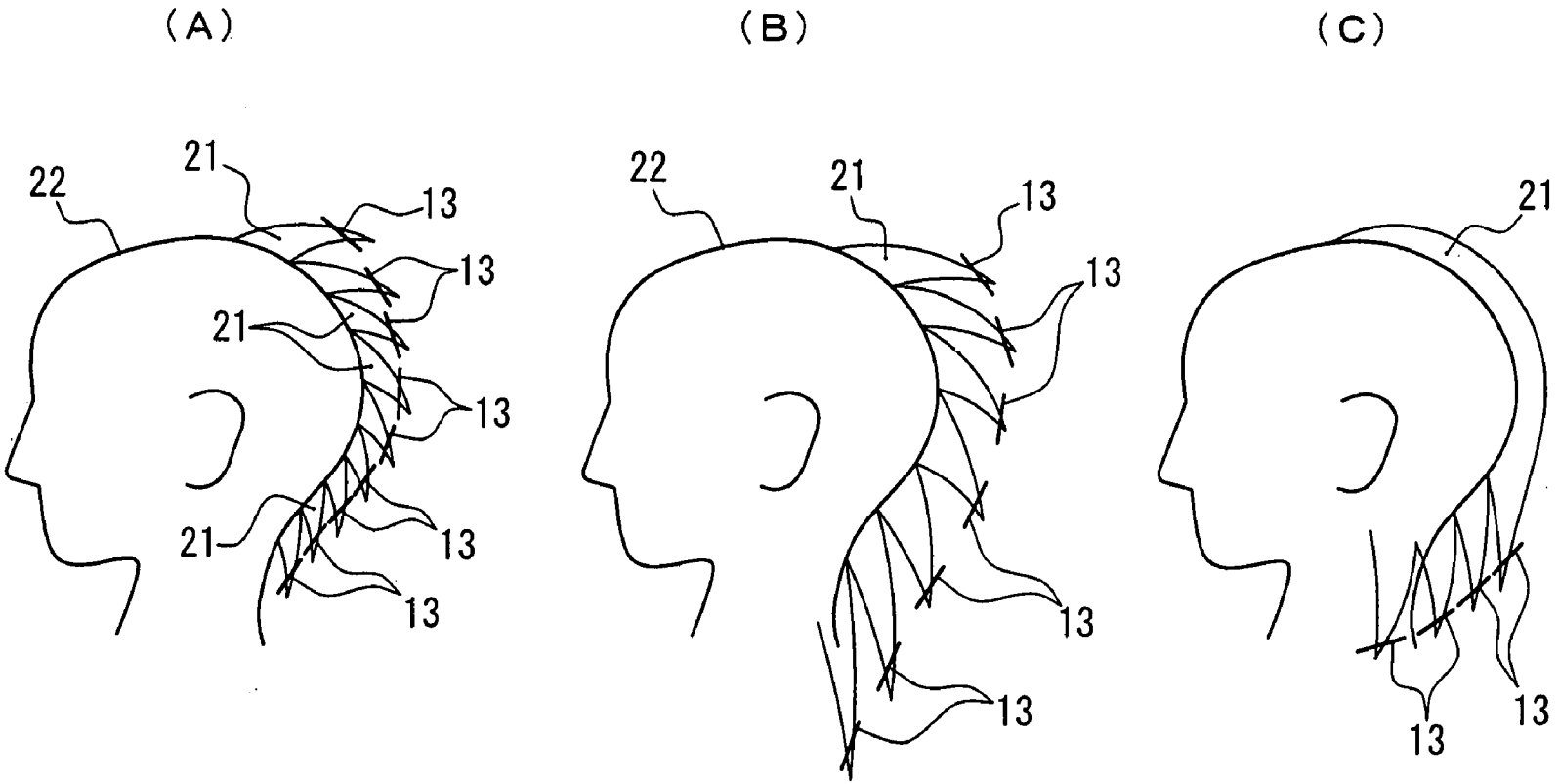
FIG. 6 show variations of hairstyles formed by the hair-trimming tool of the embodiment of the invention, wherein (A) shows short cut, (B) shows layer cut and (C) shows Bob cut.

A cutting position is determined by a position of the protruding portion (12) with respect to the hair-bunch. For example, in order to form short hair as shown in FIG. 6(A), a user allows the protruding portion (12) of the tool body (1) to come into contact with a scalp (22) directly below the picked up hair-bunch (21), and this attitude is defined as the cut-starting attitude, and the user turns the tool body (1) from this attitude. By repeating this operation, hair-bunches cut into the same outline are superposed on one another radially and vertically, and it is possible to form a short cut hair which is shaped beautifully as a whole.

To set the length of hair, the hair-bunch (21) is sandwiched between the hair-bunch supporting pieces (10*a*) and (10*b*) from a state in which the tool body (1) is set in the cut-starting attitude. In this state, the protruding portion (12) is brought into contact with the scalp, the protruding portion (12) is allowed to lower along the scalp, and when the length of the hair-bunch (21) is determined, the tool body (1) is turned around the protruding portion (12) to cut the hair. Irrespective of position of the head where the protruding portion (12) comes into contact with, if the tool body (1) is turned from a state in which the razor blade (13) is always located substantially in parallel to the scalp, a stable hair-bunch is formed irrespective of length of hair. By setting a predetermined length of the hair-bunch (21), it is possible to carry out layer cut as shown in FIG. 6(B) and Bob cut as shown in FIG. 6(C).

In order to secure reliably sharpness of the razor blade (13), it is preferable exchange the razor blade (13) whenever one person's hair cut is done. The razor blade (13) is exchanged by removing each holder (14) from the hair-bunch supporting pieces (10*a*) and (10*b*) in the above described manner. At that time, since the protruding portion (16*a*) of the safety cover (16) upwardly projects from the tip of the razor blade (13), there is no danger that a user's hand comes into contact with the tip of the razor blade (13).

A cushion member (19) may be mounted on a base end of the hair-bunch supporting pieces (10*a*) and (10*b*) as shown in FIG. 2. With this configuration, it is possible to adjust a force to be acted on the hair-bunch supporting pieces (10*a*) and (10*b*), and there is no fear that the hair is excessively cut, and hair can be cut more finely.

Figure 7:
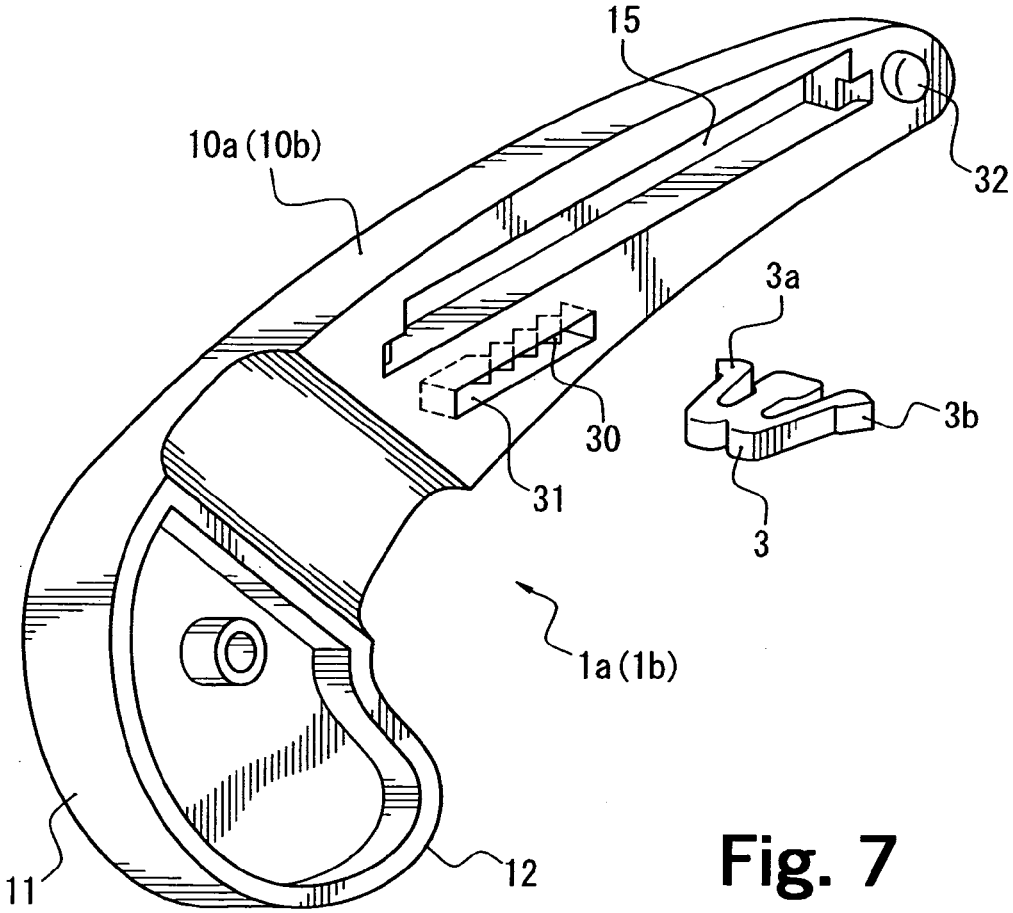
FIG. 7 is an exploded perspective view of a hair-trimming tool according to a second embodiment of the invention.

FIG. 7 is an exploded partial perspective view of a hair-trimming tool according to a second embodiment.

In this embodiment, the tool body comprises a pair of tool halves (1*a*) and (1*b*). The tool halves (1*a*) and (1*b*) respectively comprise hair-bunch supporting pieces (10*a*) and (10*b*) and connecting portions (11) and (11) continuously provided on the hair-bunch supporting pieces (10*a*) and (10*b*). The connecting portions (11) and (11) project in directions at right angles to longitudinal directions of the hair-bunch supporting pieces (10*a*) and (10*b*), and their projecting ends function as protruding portions (12) around which the tool turns.

In this embodiment, the entire hair-bunch supporting pieces (10*a*) and (10*b*) are curved into substantially arc shape along the scalp such that when the tool body is set in the cut-starting attitude where the protruding portion (12) abuts against the scalp, the hair-bunch supporting pieces (10*a*) and (10*b*) are located along the scalp. Like the first embodiment, grooves (15) for accommodating the holders are formed in corresponding inner surfaces of the hair-bunch supporting pieces (10*a*) and (10*b*) along the longitudinal directions thereof. In this embodiment, grooves (31) are formed along the grooves (15) in the vicinity of base ends of the hair-bunch supporting pieces (10*a*) and (10*b*) and inward (closer to the scalp in the cut-starting attitude) of the grooves (15).

A bottom surface (30) of the groove (31) is formed into corrugated shape. When the tool halves (1*a*) and (1*b*) are assembled such that their inner surfaces are opposed to each other, peaks and valleys of the corrugated portion are opposed to each other. A stopper (3) is interposed between the grooves (31). The stopper (3) includes a pair of spring pieces (3*a*) and (3*b*) which can be retained to the opposed valleys at the same time.

The spring pieces (3*a*) and (3*b*) can rock in depth directions of the grooves (31). Tip ends of the spring pieces (3*a*) and (3*b*) are inclined along a slant constituting the corrugated peaks and valleys. With this configuration, the stopper (3) can forcibly move in the longitudinal direction of the groove (31) while rocking the spring pieces (3*a*) and (3*b*) in the depth directions of the grooves (31).

In this embodiment, the stopper (3) functions as the holding means which holds a lower side of the hair-bunch sandwiched between the hair-bunch supporting pieces (10*a*) and (10*b*). The stopper (3) can move along the longitudinal direction of the groove (31) in accordance with an amount and length of the hair-bunch.

The using method of this embodiment is the same as that of the first embodiment. That is, the protruding portion (12)

which is the projecting end of the connecting portion (11) is turned around the protruding portion (12) from the cut-starting attitude where the protruding portion (12) abuts against the scalp in a direction in which the hair-bunch supporting pieces (10*a*) and (10*b*) are separated from the scalp. Especially in this embodiment, since the hair-bunch supporting pieces (10*a*) and (10*b*) are formed into arc shape extending along the shape of the head, it is easy to set the tool body (1) in the cut-starting attitude, and more precise shaggy cut can be realized.

In this embodiment, instead of the cushion member (19) of the first embodiment, rubber projections (32) are provided on the tip ends of the hair-bunch supporting pieces (10*a*) and (10*b*). With this configuration, it is possible to adjust a force when the hair-bunch supporting pieces (10*a*) and (10*b*) are to be closed, and there is no fear that the hair is excessively cut unintentionally.

In this embodiment, the cutting means comprising the razor blade (13) is provided on both the opposed hair-bunch supporting pieces (10*a*) and (10*b*), but the cutting means may be provided on one of the hair-bunch supporting pieces (10*a*) and (10*b*). In this case, a hair-bunch is formed into an outline in which only one side is cut.

The razor blade (13) may be electrical razor blade so that the razor blade (13) reciprocates in the longitudinal direction.

The safety covers (16) of this embodiment are disposed such that when the hair-bunch supporting pieces (10*a*) and (10*b*) are closed, the protruding portion (16*a*) of the safety cover (16) provided on the one hair-bunch supporting piece (10*a*) corresponds to the recess (16*b*) of the safety cover (16) provided on the other hair-bunch supporting piece (10*b*). Alternatively, the safety cover (16) may be able to slide in the longitudinal direction in the holder (14), and the protruding portion (16*a*) of the safety cover (16) provided on the one hair-bunch supporting piece (10*a*) corresponds to the protruding portion (16*a*) of the safety cover (16) provided on the other hair-bunch supporting piece (10*b*). In this case, when the hair-bunch supporting pieces (10*a*) and (10*b*) are closed, since the protruding portions (16*a*) abut against each other, a predetermined gap is generated between the razor blades (13). This is effective when the amount of hair-bunch is large. By sliding the safety cover (16) to adjust the relation between the protruding portion (16*a*) and the recess (16*b*) facing each other in this manner, it is possible to provide the tool body (1) suitable for the amount of hair-bunch (21).

Although the razor blade (13) is employed as the cutting means in this embodiment, the present invention is not limited to this, and hair may be cut using laser beams.

Although the hair-trimming tool is used for completing the shaggy cut in this embodiment, if the hair-bunch supporting pieces (10*a*) and (10*b*) are closed completely at a predetermined position of the hair-bunch without rotating the tool body, it is possible to carry out blunt cut in which hair tip is straightly cut using scissors.

Figure 8:
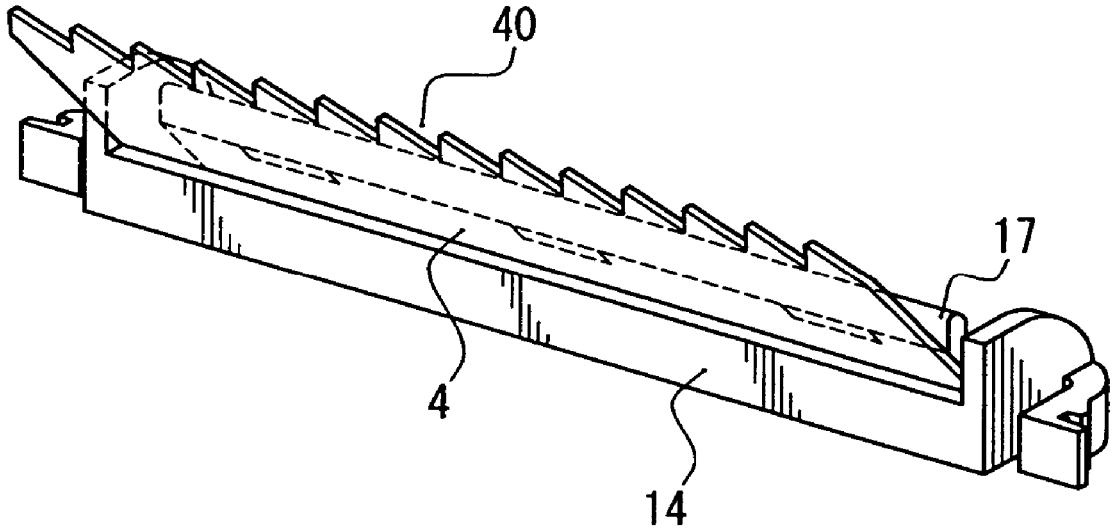
FIG. 8 is a perspective view of a holder having a comb portion of a hair-trimming tool according to a third embodiment of the invention.
Figure 9:
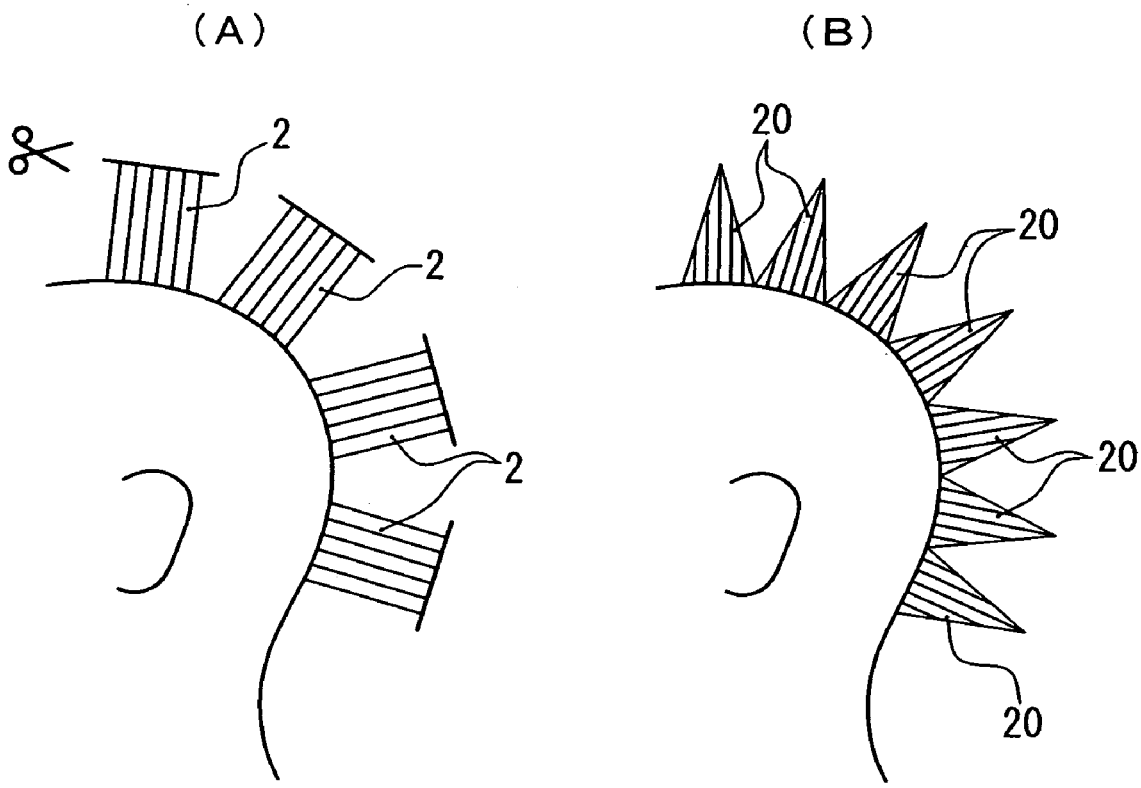
Fig. 9 ( PRIOR ART )
FIG. 9 show the manner of conventional hair cutting.

FIG. 8 shows a hair-trimming tool of a third embodiment. In the hair-trimming tool of the first embodiment, the combination of the razor blade (13) and the safety cover (16) inserted along the support plate (17) of the holder (14) shown in FIG. 3 is replaced by a comb portion (4), thereby forming the comb means.

The comb portion (4) is a metal or synthetic resin thin plate having almost the same size as those of the safety cover (16) and the razor blade (13). The comb portion (4) is formed with saw tooth-like comb teeth (40) extending along one side projecting outward of the support plate (17). The holder (14) having this comb portion (4) is accommodated in one or both of the grooves (15) of the hair-bunch supporting pieces (10*a*) and (10*b*) of the embodiment. With this configuration, a hair-trimming tool having the comb teeth (40) projecting toward the opposed surfaces of the hair-bunch supporting pieces (10*a*) and (10*b*) is completed.

When this hair-trimming tool is used, like the using manner shown in FIG. 4, the hair-bunch (21) is sandwiched between the hair-bunch supporting pieces (10*a*) and (10*b*), and the tool body (1) is turned in the direction of arrow in FIG. 4 around the protruding portion (12) which is in abutment against the scalp. With this, the hair-bunch (21) is combed up by the comb teeth (40) projecting between the hair-bunch supporting pieces (10*a*) and (10*b*) in a state in which a constant angle is maintained between the hair-bunch (21) and the scalp, and after it is turned through a predetermined angle, a tip end of the hair-bunch (21) projecting outward between the hair-bunch supporting-pieces (10*a*) and (10*b*) is cut by scissors using the other hand.

If the tool body (1) having the comb means is used, it is possible to easily carry out the same cutting technique as that of a professional hairdresser in which a hair-bunch combed up by a comb is sandwiched between fingers and supported at a constant angle to a scalp, hair tip protruding from the gap between the fingers is cut using the scissors.

If the holder (14) having the comb portion (4) and the holder (14) having the razor blade (13) and the safety cover (16) can be replaced by each other, one tool body (1) can be used as both a comb and a hair cutter.

The invention claimed is:

1. A hair-trimming tool having a tool body comprising a pair of hair-bunch supporting pieces whose tip ends can open and close, a connecting portion for connecting base ends of the hair-bunch supporting pieces with each other, a protruding portion protruding from the connecting portion in a direction substantially perpendicular to an opening and closing direction of the hair-bunch supporting pieces, and cutting means provided on opposed inner surfaces of the hair-bunch supporting pieces in its longitudinal direction, wherein the cutting means are disposed substantially in parallel to a scalp in a cut-starting attitude in which a tip end of the protruding portion comes into contact with a predetermined position of the scalp, holding means is provided on a predetermined position of a surface of the hair-bunch supporting piece, opposite the scalp, in the cut-starting attitude for holding a lower side of a hair-bunch at a constant angle to the scalp, and grooves are formed in the inner surfaces of the hair-bunch supporting pieces along a forming region of the cutting means, each cutting means comprises a holder which is detachably embedded in the groove, and a razor blade mounted along a longitudinal direction of the holder, each razor blade being fitted such that it inclines in a direction for turning the hair-bunch supporting piece at an angle of about 45° to the inner surface, wherein a thin plate-shaped safety cover is disposed along an outer surface of each razor blade, one side of each safety cover along a blade of each razor blade is a corrugated side formed with protrusions and recesses around the blade, and wherein corrugated protruding portions and recesses of the safety cover of the cutting means provided on one of the hair-bunch supporting pieces respectively correspond to corrugated recesses and protruding portions of the safety cover of the cutting means provided on the other hair-bunch supporting pieces.

2. The hair-trimming tool according to claim 1, wherein the holding means is mounted in the vicinity of a base end of the hair-bunch supporting pieces such that the holding means is capable of moving along a longitudinal direction of the hair-bunch supporting pieces.

3. The hair-trimming tool according to claim 1, wherein each of the hair-bunch supporting pieces is curved into a substantially arc shape so as to be located along a scalp in the cut-starting attitude.

4. The hair-trimming tool according to claim 2, wherein each of the hair-bunch supporting pieces is curved into a substantially arc shape so as to be located along a scalp in the cut-starting attitude.

5. The hair-trimming tool according to claim 1, wherein a resilient material is interposed between base ends of the hair-bunch supporting pieces.

6. The hair-trimming tool according to claim 2, wherein a resilient material is interposed between base ends of the hair-bunch supporting pieces.

7. The hair-trimming tool according to claim 3, wherein a resilient material is interposed between base ends of the hair-bunch supporting pieces.

8. The hair-trimming tool according to claim 4, wherein a resilient material is interposed between base ends of the hair-bunch supporting pieces.

* * * * *